United States Patent [19]

Lipscomb, II et al.

[11] 4,170,543

[45] Oct. 9, 1979

[54] ELECTRICAL INSULATING OIL

[75] Inventors: Thomas G. Lipscomb, II; Walter A. Morgan; Sam R. Bethea, all of Baytown, Tex.

[73] Assignee: Exxon Research & Engineering Co., Florham Park, N.J.

[21] Appl. No.: 555,016

[22] Filed: Mar. 3, 1975

[51] Int. Cl.[2] ..... C10G 39/00; H01B 3/22

[52] U.S. Cl. ..... 208/14; 208/89

[58] Field of Search ..... 208/14, 138, 139, 141

[56] References Cited

U.S. PATENT DOCUMENTS

| | | | |
|---|---|---|---|
| 2,921,011 | 1/1960 | Ordelt et al. | 208/14 |
| 3,006,841 | 10/1961 | Haensel | 208/139 |
| 3,714,021 | 1/1973 | Takahashi et al. | 208/14 |
| 3,839,188 | 10/1974 | Mills et al. | 208/14 |

*Primary Examiner*—Herbert Levine
*Attorney, Agent, or Firm*—J. E. Reed

[57] ABSTRACT

An electrical insulating oil having both high positive and high negative direct current breakdown voltage values is prepared by catalytically reforming a petroleum naphtha or similar feedstock and then fractionating or otherwise treating the reformed material to produce a highly aromatic oil which boils in the range between about 400° and about 700° F., contains less than about 1.0 weight percent of polar compounds, and includes less than about 2.5 weight percent of aromatic compounds having four or more condensed aromatic rings per molecule. This aromatic oil may be blended with up to about 75 volume percent, based on the total blend, of a low aromatic petroleum fraction which has been hydrogen treated, solvent extracted or acid treated to reduce its aromatics content to a level less than about 20% by weight. The aromatic oil or blend may be hydrogen treated or contacted with an adsorbent to improve further its stability and other properties. Oxidation inhibitors, pour point depressants and other additives may be added if desired. The product oil has surprisingly high breakdown strength values for both positive and negative impulse waves, low or negative gas emission values and better free-convection heat transfer properties than oils available in the past.

3 Claims, 2 Drawing Figures

ELECTRICAL INSULATING OIL

BACKGROUND OF THE INVENTION

1. Field of the Invention

This invention relates to electrical insulating oils and is particularly concerned with oils for use in transformers, reactors, circuit breakers, switches, cables and other equipment which are characterized by better electrical properties than oils available heretofore.

2. Description of the Prior Art

Electrical insulating oils used in transformers, reactors, circuit breakers, switches, cables and other equipment for insulation and cooling purposes are generally manufactured from crude oil distillates or desaphalted petroleum fractions by treating the selected feedstocks for the removal of sulfur, oxygen, nitrogen and other constituents which may adversely affect their electrical properties and oxidation resistance. The processes used include acid treating, hydrogen refining, solvent extraction, dewaxing, and treatment with clay or other adsorbents. It has been shown that the properties of such oils can be improved by limiting their aromatic contents and that the use of oxidation inhibitors and other additives is also helpful in preventing the degradation of such oils in service.

Although the methods referred to above generally permit the preparation of insulating oils which have reasonably high oxidation resistance and relatively long service life under normal conditions, experience has shown that the electrical properties of such oils often leave much to be desired. An oil which is to be used as an insulating oil in a transformer, switching system or similar device must be capable of resisting current at much higher voltage levels than those at which the device is normally operated. Lightning and other disturbances may cause voltage surges sufficiently high to break down the oil and damage the equipment. The ability of an oil to resist such surges, referred to as its impulse strength, is measured in terms of both positive and negative waves. Similarly, the ability of an oil to withstand direct current voltages is measured in terms of both the direct current positive breakdown voltage and the direct current negative breakdown voltage. Conventional electrical insulating oils generally have moderately high negative impulse strength and direct current breakdown voltage values and somewhat lower positive impulse strength and direct current breakdown voltage values. Efforts to improve these normally result in an improvement in one at the expense of the other. Oils which have both high positive and high negative impulse strength and direct current breakdown voltage values have not generally been available in the past.

Another electrical property which is of importance in insulating oils is the gassing tendency of the oil. Many conventional oils will emit hydrogen gas when subjected to an intense electrical field sufficient to cause corona or partial discharging. If a gas bubble lodges in a critical location between conductors in the windings for example, the total resistance between the windings may be lowered to such an extent that an arc may occur and cause substantial damage to the equipment. If such an oil is used in a closed system, the liberated gas may rupture the case or housing and damage the equipment. In a vented system, it may result in the formation of an explosive mixture which can be ignited by arcing. It has been found that oils with high negative impulse strengths and direct current breakdown voltage values generally have very poor gassing resistance. Other electrical properties which must also be considered include the alternating current breakdown strength and the alternating current corona inception voltage. The insulating oils available heretofore have generally been deficient with respect to one or more of these properties.

SUMMARY OF THE INVENTION

This invention provides improved electrical insulating oils which have excellent oxidation resistance and possess significantly better electrical properties than oils available heretofore. These improved oils can be prepared by catalytically reforming a petroleum naphtha or similar hydrocarbon feedstock and then fractionating, extracting or otherwise treating the reformed material to permit the recovery of a highly aromatic oil which boils in the range between about 400° and about 700° F., contains less than about 1.0 weight percent of polar compounds, and includes less than about 2.5 weight percent of aromatic compounds having four or more condensed aromatic rings per molecule. This aromatic oil can be used as an electrical insulating oil or may instead be blended with up to about 75 volume percent, based on the total blend, of a low aromatic hydrocarbon oil which has been hydrogen treated, solvent extracted, or acid treated to reduce its aromatics content to a value less than about 20% by weight. The aromatic oil or blend may be hydrogen treated or contacted with an adsorbent to improve its stability and other properties. Oxidation inhibitors, pour point depressants, and other additives may be added if desired. The insulating oil product has surprisingly high breakdown strength values for both positive and negative impulse waves, unusually high positive and negative direct current breakdown strength values, low or negative gas emission values, and better free convection heat transfer properties than oils available in the past.

A variety of different petroleum hydrocarbon feedstocks can be used in preparing the improved insulating oils of the invention. Suitable feedstocks include virgin naphthas, catalytically cracked naphthas, fluid coker naphthas, visbreaker naphthas, kerosene fractions, light gas oils, and similar petroleum fractions boiling in the range between about 100° and about 600° F., preferably between about 100° and about 400° F. Oils of comparable boiling range derived from coal, oil shale and tar sands can also be used. The particular material selected will depend in part upon the purpose for which the insulating oil is intended, the equipment in which it is to be used, and the particular processing steps to be employed. In general, the oil and the processing steps selected should be such as to produce final products having viscosities at 100° F. within the range between about 50 and about 300 Saybolt Universal Seconds, preferably between about 55 and about 100 Saybolt Universal Seconds; pour points of 15° F. or lower, preferably below about −40° F.; and flash points of at least about 265° F., preferably at least about 295° F. Oils having relatively high aromatics and naphthenes contents are usually preferred.

The feedstock employed for purpose of the invention will normally be hydrogen treated under moderate or severe conditions in the presence of a hydrogen treating catalyst to eliminate sulfur, oxygen and nitrogen compounds which might otherwise tend to deactivate the catalyst used in the catalytic reforming step and cause increased corrosion. Some saturation of olefins and minor conversion of aromatic hydrocarbons into naphthenes may also occur. If the feed stream selected has a relatively low sulfur content, this preliminary hydrogen treating step may be omitted. In the catalytic reforming step of the process, the feed material is contacted with a reforming catalyst at elevated temperature and pressure. This results in the conversion of paraffins into naphthenes, the isomerization of naphthenes and paraffins, the conversion of lower boiling naphthenes into higher boiling aromatics, the hydrocracking of heavier constituents into lower molecular weight materials, and the formation of heavier polynuclear aromatics from lighter constituents. The reforming operation may be carried out with a precious metal catalyst such as platinum on alumina or alumina-silica or with a nonprecious metal such as molybdena, chromia, or cobalt-molybdena on alumina or a similar carrier and may be of either the cyclic or regenerative type. Reaction conditions will normally include temperatures in the range from about 750° to about 1000° F., pressures between about 150 and about 500 psig, recycle gas rates in the range of from about 2000 to about 10,000 SCF/bbl, and space velocities of about 0.2 to 2.0 V/Hr./V.

Following the reforming step of the process, the reformed oil is normally fractionated, extracted or otherwise treated to permit the recovery of a highly aromatic fraction which boils between about 400° F. and about 700° F., preferably between about 400° and about 625° F., contains less than about 1% polar compounds, and includes less than about 2.5% of aromatic compounds having four or more condensed rings per molecule.

The aromatic oil prepared as described above may be used as an insulating oil per se but will preferably be blended with up to about 75% by volume, based on the total blend, of a petroleum distillate which has been hydrogen treated, solvent extracted or acid refined to reduce its total aromatics content to 20% by weight or less. Hydrogen treating procedures similar to or more severe than those referred to above may be used. Conventional solvent extraction techniques using phenol, furfural or a similar solvent and known acid treating methods carried out with sulfuric acid can be employed. The aromatic oil or blend may be further hydrogen refined or percolated over a bed of clay, charcoal or other adsorbent to improve its color, interfacial tension, dissipation factor, neutralization number and oxidation stability. Oxidation inhibitors and pour point depressants may be added to the final product if desired and will normally be used.

The electrical insulating oils of the invention have significantly better electrical properties than conventional oils available in the past and are particularly outstanding with respect to their direct current impulse strength values and gassing properties. Although oils with relatively high negative direct current impulse strength values have been available heretofore, such oils have normally had positive direct current impulse strength values on the order of about 100 kilovolts or lower. Efforts to increase these positive values have generally been unsuccessful. Moreover, efforts to improve either the positive or negative impulse values have generally had an adverse effect on the gassing properties. Typically, gassing values have been either positive or only slightly negative, usually above about −10 μl/min. The oils prepared in accordance with the invention, on the other hand, generally have negative direct current impulse values in excess of about 200 kilovolts, positive direct current impulse values in excess of about 130 kilovolts, and negative gassing tendencies of about −20 μl/min. or lower. These properties represent a significant improvement over those of conventional electrical insulating oils and make the oils prepared in accordance with the invention attractive for use in a wide variety of different types of electrical equipment. Typical equipment in which the improved oils may be employed includes high voltage transformers, reactors, circuit breakers, switches, cables and related devices requiring the presence of cooling and insulating oils able to withstand currents at high voltage levels without evolving significant quantities of hydrogen gas. Such equipment has been described at length in the literature and will be familiar to those skilled in the insulating oil art.

DESCRIPTION OF THE PREFERRED EMBODIMENTS

Figure 1:
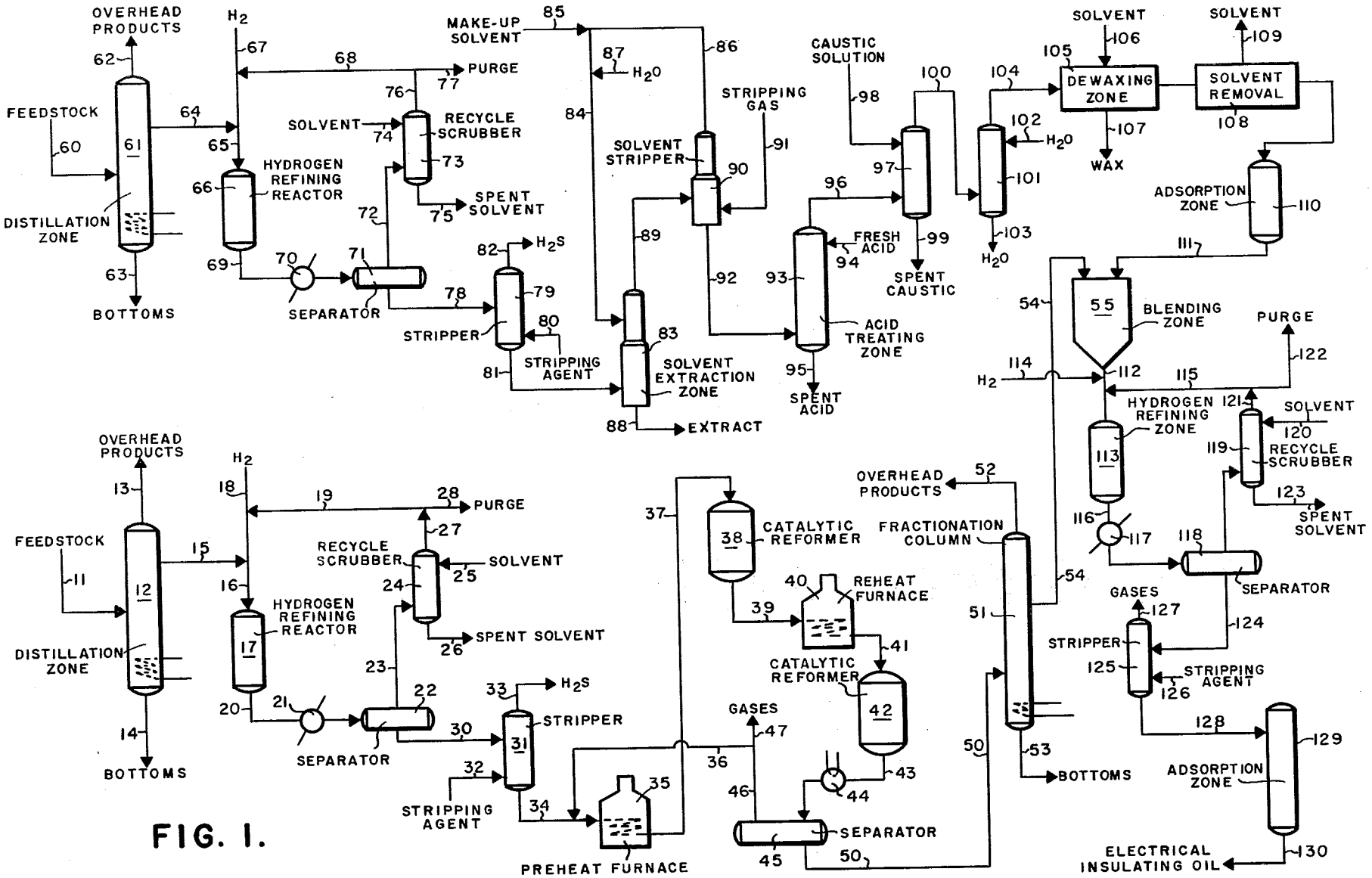
FIG. 1 in the drawing is a schematic flow diagram illustrating the manufacture of an improved electrical insulating oil in accordance with the invention.

The process depicted in the drawing is one for the manufacture of an insulating oil by the hydrogenation, catalytic reforming and distillation of a hydrocarbon feedstock to produce a highly aromatic oil which boils between about 400° F. and about 625° F., contains less than 1% polar compounds, and includes less than 2.5% of aromatic compounds containing four or more condensed aromatic rings and the blending of this aromatic oil with a petroleum distillate fraction which has been hydrogen refined, solvent extracted or acid treated to reduce the aromatics content to a value of 20% or lower. The initial feedstock employed in the process illustrated is introduced into the system through line 11 from which it is fed into fractionation tower 12. This initial feedstock may be a crude oil, a broad boiling range petroleum distillate, or the like. The particular oil selected will depend in part upon the application for which the insulating oil is intended, the refinery streams available as feedstocks, and the processing step to be employed. In tower 12, this initial feedstock is fractionated to eliminate volatile constituents which may have low flash points and other undesirable properties and heavy constituents that may adversely affect the oil's electrical properties and stability. The volatile components are taken off through line 13. A liquid fraction of the desired boiling range, generally between about 100° and 700° F. and preferably between about 100° and about 400° F., is withdrawn from column 12 through line 15. Other side streams are not shown in FIG. 1. This preliminary fractionation step can be eliminated if a suitable feedstock is available from other sources.

The feed stream withdrawn through the line 15 is passed through a suitable preheat furnace, not shown in the drawing, and line 16 into hydrogen refining reactor 17, along with makeup hydrogen fed into the system through line 18 and recycle hydrogen introduced through line 19. The feedstock and hydrogen thus introduced are contacted in the reactor with a hydrogenation catalyst such as nickel, platinum, rhenium, nickel tungstate, nickel tungsten sulfide, nickel molybdenum, molybdena on alumina, molybdenum sulfide, cobalt molybdate on alumina, nickel molybdate on alumina, or the like. A variety of commercial hydrogenation catalysts, used in either a fixed or moving bed, may be employed for purposes of the invention. Hydrogenation processes for the removal of sulfur, oxygen and nitrogen compounds, the saturation of olefins, and the conversion of aromatics into naphthenes using both fixed bed and moving bed techniques have been described in the literature and will be familiar to those skilled in the art. The particular process employed will depend in part on the boiling range of the feedstock to be treated, the amount of sulfur and other unstable constituents present, and other factors. In general, however, it is normally preferred to employ a fixed bed process utilizing relatively mild hydrogenation conditions. Although only a single reaction vessel is shown in the drawing, two or more reactors may be provided in order to facilitate regeneration of the catalyst without interrupting the process.

The hydrogen refining treatment carried out in reactor 17 will normally be conducted at a temperature within the range between about 400° F. and about 750° F., preferably between about 475° F. and about 630° F., and at a pressure within the range from about 200 psig to about 1000 psig, preferably between about 650 and about 750 psig. A feed rate between about 0.1 and about 5.0 volumes of feed per hour per volume of catalyst, preferably between about 1 and 2 volumes per hour per volume, and a hydrogen treat rate between about 100 and about 5000 SCF/bbl., preferably between about 500 and about 1000 SCF/bbl., will generally be employed. Relatively low boiling feedstocks of moderately low sulfur content can generally be treated at conditions near the lower ends of the above ranges to produce materials of acceptable quality; whereas higher boiling fractions containing relatively large quantities of sulfur and other unstable constituents will generally require somewhat more severe hydrogenation conditions. The efficiency of the particular catalyst employed will also affect to a considerable extent the conditions used in the hydrogenation step of the process. It is usually preferred that the hydrogenated material obtained from the hydrogenation step have a sulfur content of about 10 ppm or less. As pointed out earlier, this initial hydrogenation step is not always essential and can be omitted if a suitable feed stream of sufficiently low sulfur content is available.

The hydrogenated effluent withdrawn from hydrogenation reactor 17 is passed through line 20 and cooler 21 to liquid gas separator 22. Hydrogen-containing gases and hydrogen sulfide are taken off overhead from the separator through line 23 and may be scrubbed in recycle scrubber 24 with a solvent such as triethanolamine introduced through line 25. The spent solvent is withdrawn from the scrubber through line 26 and may be regenerated in the conventional manner. The scrubbed gases, composed primarily of hydrogen, are taken overhead from the scrubber through line 27 and recycled through line 19 to the hydrogenation reactor. In order to maintain the hydrogen concentration of the recycle gas within acceptable bounds, a portion of the gas is withdrawn as a purge stream through line 28.

The liquid constituents from which the gases are separated in liquid-gas separator 22 are withdrawn through line 30 and passed to stripper 31 where steam or other stripping agent is introduced by means of line 32 to drive off hydrogen sulfide and light products. The hydrogen sulfide and stripping agent are taken off overhead through line 33 and may be passed to a sulfur recovery unit. A low sulfur hydrocarbon stream is withdrawn from the stripper through line 34. This material may have a somewhat lower aromatics content than the initial feedstock and will contain only very small quantities of olefins and sulfur, oxygen and nitrogen compounds.

The hydrogen treated product withdrawn from stripper 31 through line 34 is introduced into catalytic reforming preheat furnace 35, along with recycle gas from line 36. Here the feed material to the catalytic reforming step of the process is heated to the reforming temperature, normally between about 850° and about 1000° F. The hot feed material from the furnace is passed through line 37 into reformer reaction vessel 38 where it is contacted with a reforming catalyst at a pressure between about 250 and about 500 psig. The reforming operation depicted in the drawing is a semiregenerative process in which a precious metal type catalyst such as platinum on alumina or silica-alumina is maintained in a fixed bed and regenerated at periodic intervals. Several such processes, as well as cyclic and fluid bed processes which may be employed, have been described in the literature and will be familiar to those skilled in the art. The effluent from reactor 38 is withdrawn through line 39, passed through preheat furnace 40 and introduced by means of line 41 into a second reforming reactor 42. More than two reactors can be employed if desired.

In the reforming step of the process, paraffinic compounds are dehydrocyclized and isomerized, lower molecular weight naphthenes are dehydrogenated to form aromatics, naphthenes are isomerized, and some high molecular weight constituents in the feedstock may be hydrocracked to produce lower molecular weight materials. The product is normally an oil which has a somewhat higher boiling range than the initial feedstock, contains polynuclear aromatic compounds having 4 or more condensed aromatic rings in relatively low concentrations, and is relatively free of polar compounds. This oil, along with gaseous products formed during the reforming reaction, is withdrawn from reactor 42 through line 43, passed through cooler 44, and introduced into separator 45. Here gaseous constituents are separated from the liquids and withdrawn through line 46. A major portion of this gas will normally be passed through a drier, not shown in the drawing, and then recycled by means of line 36 to the reformer preheat furnace. Gas recycle rates will normally be in the range of from about 2000 to about 10,000 SCF/bbl. The remaining gas, which contains both hydrogen and hydrocarbon compounds, is withdrawn through line 47 for recovery.

The reformed liquid product produced as described above is withdrawn from separator 45 and may be introduced through line 50 into fractionation column 51. Here the oil is preferably separated into an overhead fraction including constituents present in the initial feed stream to the reforming unit and low boiling constituents formed during the reforming operation; an intermediate fraction which boils between about 400° F. and about 625° F., contains less than about 1% of polar compounds, and includes less than about 2.5% of aromatic compounds having 4 or more condensed aromatic rings per molecule; and a heavy bottoms fraction boiling in excess of about 625° F. which may include polynuclear aromatics containing 4 or more condensed rings in substantial quantities. The overhead fraction is withdrawn through line 52 and is recovered for use as a fuels blending stock or the like. The bottoms fraction, taken off through line 53, may be employed as a catalytic cracking feedstock, a fuel constituent, or the like. The intermediate fraction to be employed in the electrical insulating oil of the invention will be a highly aromatic oil composed primarily of aromatic compounds produced from lower boiling naphthenes during the reforming operation. By employing a relatively low boiling reformer feed stream and fractionating the reformed product so that the initial boiling point of the intermediate fraction withdrawn through line 54 is higher than the final boiling point of the feed stream, an intermediate fraction having an aromatics content of 95% or higher can be obtained without the necessity for an extraction step to segregate aromatics. This fraction is withdrawn from the fractionation column and passed by means of line 54 to a blending tank or similar vessel 55. Other intermediate fractions useful for other purposes can also be recovered from column 51 as side streams not shown in FIG. 1 if desired. The condensing, refluxing and cooling equipment normally associated with the withdrawal of such a fraction is not shown in the drawing.

In lieu of using a feed stream of relatively low final boiling point and fractionating to recover an intermediate stream with an initial boiling point above the end point of the feed stream as described above, the aromatic oil employed for purposes of the invention can be prepared by catalytically reforming a broader boiling range feed stream, fractionating the reformate to recover a fraction boiling in the range between about 400° F. and about 700° F., preferably between about 400° F. and about 625° F., and then extracting this fraction with tetrahydrothiophene 1-1 dioxide, diethylene glycol, n-methylpyrrolidone, dimethyl sulfoxide, n-n dimethylformamide, morpholine, methyl carbonate, phenol or the like to recover the aromatics. Alternatively, the reformate may in some cases be solvent extracted and then fractionated into aromatics fractions of the desired boiling range if desired. Solvent extraction processes suitable for the segregation of aromatic compounds from the catalytically reformed feed material have been described in the literature and will be familiar to those skilled in the art. Other methods such as adsorption and the like which will permit the recovery of an aromatics fraction which boils between about 400° and about 700° F., contains less than about 1% polar compounds, and includes less than about 2.5% of aromatic compounds having 4 or more condensed rings per molecule can also be used.

The oil produced as described above may be hydrofined or treated with clay or a similar absorbent to further improve its stability if desired and then employed as an electrical insulating oil. In many cases, however, it will be preferred to blend this oil with up to about 75% by volume of a hydrocarbon oil which has been hydrogen treated, solvent extracted, or acid refined to reduce its total aromatics constant to about 20% by weight or less. This oil may also be dewaxed if desired. The process depicted in the drawing includes the preparation and use of such an oil as a constituent of the finished electrical oil.

The oil which is blended with the refined aromatic fraction prepared as described above is obtained, in the process of FIG. 1, by charging a suitable petroleum feedstock, a naphthenic or paraffinic crude oil for example, through line 60 into distillation column 61. Overhead products boiling below about 350° F., preferably below about 400° F., are withdrawn from the distillation zone through line 62. A bottoms fraction boiling above about 900° F., preferably above about 750° F., is taken off by way of line 63. An intermediate fraction intended for use as an electrical oil blending stock is withdrawn through line 64 and further processed to reduce the aromatics content to a level below about 20% by weight.

As indicated earlier, the process of the invention contemplates the use of hydrogen refining, solvent extraction, acid treating, or a combination of these steps for the preparation of an oil having an aromatics content less than about 20 percent by weight and if necessary the dewaxing of this oil. The steps employed will depend in part upon the particular starting material used and other factors. If a severe hydrogen refining step resulting in the conversion of a substantial portion of the aromatics into naphthenes is employed for example, solvent extraction and acid treating of the oil will ordinarily be unnecessary. If an acid treating step is used, the solvent extraction step can generally be omitted and in many cases the hydrogen refining step will also be unnecessary. If an oil containing paraffins in relatively low concentrations is used, the dewaxing step may not be needed. It will thus be understood that all of the process steps shown downstream of fractionation tower 61 in FIG. 1 will not ordinarily be required and that various combinations of these steps may be used.

In the process shown the intermediate fraction is first passed through a hydrogen refining preheat furnace, not shown in the drawing, and then introduced through line 65 into hydrogen refining reaction vessel 66. Here the oil feed, together with makeup hydrogen admitted into the system through line 67 and recycle hydrogen from line 68, is contacted with a hydrogen refining or hydrogenation catalyst which may be any of those referred to earlier. A space velocity or feed rate from about 0.1 to about 5.0 volumes of feed per hour per volume of catalyst, preferably between about 1 and 2 volumes per hour per volume, and a hydrogen treat rate of between about 100 and about 5000 SCF/bbl., preferably between about 100 and 1000 SCF/bbl., will generally be used. A hydrogenation temperature between about 400° F. and about 700° F., preferably between about 475 and about 630° F., and a pressure from about 200 psig to about 1000 psig, preferably between about 650 and about 750 psig, may be employed. Under these conditions, sulfur compounds present in the oil are converted to hydrogen sulfide, oxygen and nitrogen compounds are reduced to hydrocarbons, olefins are saturated, and aromatics are in part converted into naphthenic compounds.

The hydrogen consumption will ordinarily be between about 2 and about 500 SCF/bbl, depending on the oil being treated. The hydrogen refined distillate is withdrawn through line 69, passed through cooler 70 and fed into separation zone 71. Here gaseous products are taken overhead through line 72 and may be introduced into recycle scrubber 73 where they can be contacted with solvent introduced through line 74. If this procedure is used, spent solvent is withdrawn by means of line 75 and the gases, composed primarily of hydrogen, are taken overhead from the scrubber through line 76 and recycled to the hydrogen refining reactor by way of line 68. A portion of the gas stream is withdrawn as a purge stream through line 77 in order to maintain the hydrogen concentration at the desired level. The liquid products from liquid-gas separator 71 are withdrawn through line 78, contacted with steam or other stripping agent introduced into stripper 79 through line 80, and withdrawn from the stripper by means of line 81. The hydrogen sulfide and stripping agent are taken overhead from the stripper through line 82.

In the process shown in FIG. 1, the hydrogen refined oil prepared as described above is introduced through line 81 into solvent extraction zone 83 where it is contacted, preferably in a countercurrent multiple stage liquid-liquid extraction system, with a solvent which is preferentially selective for aromatic constituents. Suitable solvents include phenol, sulfur dioxide, furfural, cresol, aniline, nitrobenzene, dimethylsulfoxide, $\beta$-$\beta$ dichloroethyl ether and the like. The solvent introduced into extraction column 83 through line 84 includes makeup solvent admitted into the system through line 85 and recycle solvent from line 86. Water used in the solvent solution is added through line 87. The composition of the solvent solution and the contacting conditions employed will depend to a large extent on the particular solvent selected. Typically, for example, a phenol solution containing up to about 15% water may be used and the oil may be contacted with this solution at a temperature within the range between about 100° F. and about 230° F. with a solvent-to-oil ratio of about 0.6 to 1 to 3.0 to 1 in order to limit the extraction operation to removal of the more highly aromatic constituents of the oil. The use of solvents other than phenol will generally dictate that somewhat different contacting conditions be employed.

The extract phase from the contacting step is removed from extraction zone 83 through line 88 and passed to a recovery unit not shown in the drawing for separation of the solvent from the highly aromatic constituents extracted from the oil. The raffinate phase is withdrawn from the extraction zone through line 89 and introduced into solvent stripper 90 where stripping gas introduced through line 91 is used to remove solvent from the raffinate phase. The furnaces and other equipment normally used in the extraction operation are not shown in the drawing but will be familiar to those skilled in the art. The solvent-free raffinate oil is discharged from the stripped through line 92. This oil will have a lower aromatics content than the oil fed to the extraction step and will therefore be more suitable than the feed oil for purposes of the invention. The solvent recovered from the raffinate is withdrawn through line 86 for reuse in an extraction operation. Solvent recovered from the extract phase will normally also be recycled. This conventional recovery operation is not shown in the drawing.

The raffinate oil, in the particular process shown in the drawing, is subjected to an acid treatment. This oil is introduced from line 92 into acid treating zone 93 where it is contacted with fresh sulfuric acid admitted into the system through line 94. The acid employed will normally be from about 85 to about 98% in strength. The spent acid from the acid treating step is withdrawn through line 95 and passed through an acid recovery unit not shown. The acid-treated oil is removed through line 96 to a caustic washing zone 97 where it is washed with a sodium hydroxide or similar alkali solution introduced through line 98 in order to neutralize the acid. The spent caustic withdrawn through line 99 is passed to a caustic recovery unit. The acid-treated oil is passed through line 100 to scrubber 101 and washed with water from line 102 to remove residual caustic. The wash water is taken out through line 103 for further treatment. The oil from the scrubber may, if desired, be contacted with an adsorbent for removal of trace contaminants and then passed through line 104 to a conventional dewaxing unit 105 where it can be contacted with propane, methyl ethyl ketone or a similar solvent introduced through line 106 for the removal of wax through line 107. Solvent may be removed from the dewaxed oil in solvent removal zone 108 and recovered through line 109. Following this the oil will normally be dried in a drier or adsorption zone 110 containing anhydrous calcium sulfate, alumina, a molecular sieve or the like. The dehydrated oil is then passed through line 111 to blending zone 55 for use in preparing the electrical insulating oil of the invention.

Although the process shown in the drawing includes separate hydrogen refining, solvent extraction and acid treating steps, it should again be understood that all of these steps may not be necessary to produce the low aromatics fraction used in the blending step and that any combination of hydrogen refining, solvent extraction or acid treating may be employed. The particular steps and sequence used will depend primarily upon the aromatics content of the feed oil and may be varied as necessary. The aromatic oil produced by hydrogen refining, catalytic reforming and fractionation of the aromatic feedstock may be blended with up to about 75 volume percent of the low aromatics oil as described above if desired. For economic reasons, the use of such a blend is normally preferred but in some cases the low aromatics fraction may be omitted.

The aromatic oil or blend of aromatic oil and low aromatics fraction produced in blending zone 55 may be withdrawn from the blending zone through line 112 and fed into hydrogen refining zone 113. Makeup hydrogen admitted through line 114 and recycle hydrogen from line 115 are added to the feed oil for use in the hydrogen refining operation. The hydrogen refining conditions may be similar to those described earlier. The treated oil is withdrawn through line 116, passed through cooler 117 and fed into liquid-gas separator 118. The gaseous constituents taken overhead from the separator are introduced into recycle scrubber 119 where they are washed with solvent introduced through line 120. The scrubbed gas is taken off overhead through line 121 for recycle through line 115. Again a portion of the gas stream is purged through line 122 to maintain the required hydrogen concentration. The spent solvent is withdrawn through line 123 for recovery. The liquid phase from the liquid-gas separator is taken off through line 124 and passed to stripper 125. Here any gases remaining are removed by means of stripping agent introduced through line 126 and are taken off overhead through line 127. The treated oil may be passed by means of 128 into adsorption zone 129 where it is contacted with clay, activated carbon or a similar solid adsorbent for the removal of color bodies, surface active constituents and any other impurities remaining in the oil. The contacting temperature may range from aout 0° to about 120° F. and the treat rate will normally be between about 0.05 and about 1.0 pound of clay or other material per gallon of oil. The oil withdrawn from the adsorption step by means of line 130 may be employed as an electrical insulating oil in accordance with the invention. Again it will be understood that the hydrogen refining and adsorption steps may not be required for the removal of impurities from the blended oil and that these steps can therefore in some cases be omitted. Oxidation inhibitors, pour point depressants and other additives may be incorporated in the oil as desired.

The advantages of the improved oils of this invention over conventional electrical insulating oils are illustrated by the results of tests of five different electrical oils marketed by major manufacturers for use in transformers and similar electrical equipment, a blended oil prepared in accordance with the invention, and the two components used in preparing the blend. The first of these two components was an aromatic oil boiling between 414° F. and 600° F. which was prepared by hydrogenating a petroleum naphtha to eliminate sulfur, nitrogen and oxygen compounds and saturate olefins, catalytically reforming the hydrogen treated naphtha, and then fractionating the reformed product to recover an intermediate fraction which boiled above the end point of the feed naphtha, contained less than about 0.2 weight percent of polar compounds, and was essentially free of polynuclear aromatic compounds having four or more condensed aromatic rings per molecule. A typical mass spectrographic analysis of this oil, made by using clay-gel separation to obtain aromatic, saturate and polar fractions and then analyzing the aromatic fraction on the MS-9 instrument and the saturate fraction on the CEC mass spectograph, was as follows:

Table I

| Aromatic Oil Mass Spectrographic Analysis | Weight Percent* |
|---|---|
| Saturate Fraction | |
| normal paraffins and isoparaffins | 0.094 |
| 1-ring naphthenes | 0.039 |
| 2-ring naphthenes | 0.026 |
| 3-ring naphthenes | 0.025 |
| 4-ring naphthenes | 0.017 |
| 5-ring napthenes | 0.005 |
| 6-ring naphthenes | 0.0 |
| | 0.206 |
| Aromatic Fraction | |
| cycloolefins | 0.0 |
| cyclodiolefins | 0.027 |
| 1-ring aromatics | 5.452 |
| indanes | 6.259 |
| indenes | 0.921 |
| naphthenes | 70.879 |
| acenaphthenes | 13.893 |
| fluorenes | 2.018 |
| phenanthrenes | 0.089 |
| indenobenzofurans | 0.076 |
| | 99.614 |
| Polar Fraction** | 0.180 |
| Total Sample | 100.00 |

*Normalized values
**By difference

The second component used in the blended oil prepared in accordance with the invention was a low aromatics petroleum fraction prepared by fractionating a naphthenic crude oil to recover an intermediate fraction boiling between about 476° F. and about 738° F. and then extracting this distillate with phenol containing about 8 percent added water to reduce the aromatics content to a level below 20 percent by weight. The extraction temperature was 132° F. at the top of the column and 126° F. at the bottom, and the treat level was between about 155 and about 160 percent by volume, based on the oil. The raffinate recovered contained 13.5 weight percent aromatics and had the following gas chromatographic distillation characteristics:

Table II

| Gas Chromatographic Distillation Data* | |
|---|---|
| Volume Distilled | Temperature, °F. |
| 0.3% | 476 |
| 10.0% | 552 |
| 50.0 | 625 |
| 90.0% | 700 |
| 99.0% | 736 |

*F&M Model 500 programmed temperature gas chromatograph using thermistor-type detector with 6 ft. × ¼ in. column packed with 0.5 percent of SE-30 on Chromosorb W. SE-30 is a dimethyl polysiloxane marketed by Dow-Corning Corp. and Chromosorb W consists of small particles of treated and purified diatomaceous earth marketed by Johns-Manville Products Corporation.

The two components prepared as described above were blended to produce a blend containing 43 volume percent of the low aromatics oil derived from the naphthenic crude oil and 57 volume percent of the highly aromatic fraction prepared by hydrotreating the petroleum naphtha, catalytically reforming the hydrotreated material, and then fractionating the reformate.

The electrical properties of the five commercial insulating oils, the blended oil, and the blending components used for purposes of the invention were then tested to determine their impulse strengths, direct current breakdown voltages, and gassing tendencies. The impulse strength tests were carried out in accordance with ASTM method D-3300 using needle to grounded sphere electrodes with a one-inch gap in a standard test cell containing the oil to be tested. The impulse strengths were determined by applying 1.2×50 microsecond positive and negative impulses to the needle electrode at successively higher voltages until current arced through the oil to the half-inch spherical electrode. The direct current breakdown voltages were determined in a generally similar manner except that an electrode spacing of one-fourth inch was used and a positive or negative direct current voltage which increased at the rate of 3 KV per second was applied to the needle electrode until breakdown occurred. There is no standard ASTM test for direct current breakdown voltage. The gassing tendency was determined by ASTM Method D-2300-B. In this test, a sample of the oil is subjected to a voltage of 10 KV at 65° C. under a hydrogen atmosphere and the volume of hydrogen evolved or absorbed by the oil is determined. The results of these tests are set forth in the following table.

Table III

| Tests of Electrical Properties of Insulating Oils | | | | | | |
|---|---|---|---|---|---|---|
| | | DC Breakdown Voltage, KV | | Impulse Breakdown Voltage, KV | | Gassing |
| Sample | Material | Point Negative | Point Positive | Point Negative | Point Positive | μl/min. |
| (1) | Commercial Oil A | 87 | 47 | 250+ | 100 | — |
| (2) | Commercial Oil B | 80 | 37 | 187 | 95 | — |
| (3) | Commercial Oil C | 78 | 47 | 172 | 101 | — |
| (4) | Commercial Oil D | 67 | 36 | 153 | 100 | −3 |
| (5) | Commercial Oil E* | 55 | 41 | 125 | 101 | — |
| (6) | Aromatic Oil produced by Hydrogenation, Catalytic | | | | | |

Table III-continued

| Sample | Material | Tests of Electrical Properties of Insulating Oils: DC Breakdown Voltage, KV, Point Negative | DC Breakdown Voltage, KV, Point Positive | Impulse Breakdown Voltage, KV, Point Negative | Impulse Breakdown Voltage, KV, Point Positive | Gassing μl/min. |
|---|---|---|---|---|---|---|
| | Reforming and Fractionation | 92 | 79 | — | — | — |
| (7) | Low Aromatic Petroleum Fracton Raffinate containing 13.5 wt. % Aromatics | 73 | — | 279 | — | +6 |
| (8) | Blend of 57 vol. % of (6) and 43 vol. % of (7) | 94 | 103 | 246 | 143 | −106 |

*This oil was commercially available at the time the tests were run but is no longer marketed by the manufacturer.

It will be noted from the above table that the negative direct current and impulse breakdown voltage values for all of the commercial oils were substantially higher than the corresponding positive voltage values. These oils are representative of virtually all commercially available electrical insulating oils in this respect. The aromatic and blended oils of the invention, on the other hand, both had positive and negative direct current breakdown voltage values which were very close to one another and were surprisingly higher than those of any of the commercial oils. Similarly, the positive and negative impulse breakdown voltage values for the oils of the invention were significantly better than those of the commercial oils. The direct current and impulse breakdown voltage values shown by these tests are indicative of the electrical stability of the oils and demonstrate that the oils of the invention are markedly superior to conventional oils.

The blended oil of the invention also demonstrated superior gassing tendencies. Positive values in this test indicate the volume of gas evolved; while negative values indicate that gas was absorbed by the oil. Although only one of the commercial oils shown in Table III was tested for gassing, most such oils have low positive values or, as in the case of the commercial oil that was tested, negative values slightly below zero. In general, the gassing values tend to vary as a function of the negative impulse breakdown voltage values. High negative impulse breakdown voltage values are normally accompanied by high positive gassing values. It is generally necessary to sacrifice desirable gassing properties to secure superior negative impulse values and vice versa. It will be noted, however, that the blended oil of the invention was outstanding with respect to not only direct current and impulse breakdown voltage values but gassing tendencies as well. Such superiority is unexpected and again illustrates the surprising advantages of the oils of the invention over conventional electrical insulating oils.

The superiority of the oils of the invention is further illustrated by a comparison of the impulse breakdown voltage and gassing values for the blended oil prepared as described above and three other insulating oils, a conventional transformer oil, a low impulse transformer oil, and a high impulse transformer oil. The impulse strengths of these four oils are shown in Table IV below:

Table IV

| | Comparison of Transformer Oils: Impulse Breakdown Strength[1] ASTM Method D-3300, Negative Wave | Positive Wave | Gassing[3] ASTM D-2300 B μl/min. |
|---|---|---|---|
| Conventional Transformer OIl | 152 KV | 100 KV | −11.1 |
| Low Impulse Transformer Oil | 109 KV | 80 KV | −7.4 |
| High Impulse Transformer Oil | 356 IV | 69 KV | +5.9 |
| Blended Oil of the Invention[2] | 246 KV | 144 KV | −105.7 |

[1]1.2 × 50 μ sec wave, needle to sphere electrodes, 1-inch gap.
[2]Blend of 57 parts of 414° F. to 600° F. aromatic fraction derived from catalytically reformed naphtha and 43 parts of phenol extracted naphthenic distillate.[3]Positive value means gas evolved during test; negative value means gas absorbed during test.

The data in Table IV show that the blended oil of the invention was significantly better than any of the three transformer oils. It had a higher positive impulse breakdown voltage and a better gassing value than any of the three oils and had a higher negative impulse breakdown voltage than two of the three.

As pointed out earlier, the oils of the invention are not restricted to the blended oil used in the tests reported above. The aromatic oil produced by hydrogenation, catalytic reforming, and fractionation or the like can be employed as a superior electrical insulating oil without being blended with a low aromatics constituent. This is further demonstrated by the results of tests of the alternating current and direct current breakdown voltage values for such an aromatic oil and a high grade conventional transformer oil. These results are set forth in Table V below:

Table V

| Sample | Comparison of AC and DC Breakdown Voltages: AC Breakdown Voltage Values, ASTM-D 877 | AC Breakdown Voltage Values, ASTM D 1816 | DC Breakdown Voltage Values[1], Point Negative | DC Breakdown Voltage Values[1], Point Positive |
|---|---|---|---|---|
| Conventional Transformer OIl | 33.0 KV | 37.0 KV | 61.3 KV | 35.7 KV |
| Aromatic Oil of the Invention[2] | 52.9 KV | 50.3 KV | 104.9 KV | 96.7 KV |

[1]Point to sphere electrodes, 0.25-inch gap.
[2]Aromatic oil produced by hydrogenation of petroleum naphtha, catalytic reforming of hydrogenated product, and fractionation of reformate to produce a distillate boiling above the end point of the feed naphtha but below 600° F.

It should be noted that both the alternating current and direct current breakdown voltages for the aromatic oil prepared in accordance with the invention were substantially better then those for the conventional transfomer oil. Particularly noteworthy is the fact that the positive and negative direct current breakdown voltages for the aromatic oil were very close to one another; whereas the positive value for the conventional oil was substantially lower than the negative value. This again illustrates the unexpected advantages of the oils of the invention over oils which have been available in the past.

The aromatic oils of the invention can be blended with any of a variety of low aromatic electrical oil basestocks to produce blends having superior properties. This is illustrated by the results obtained with a 500° to 600° F. isoparaffinic fraction obtained by the hydrogenation of alkylate bottoms. This fraction contained about 50% isoparaffins, substantial quantities of naphthenes and olefins, and about 3% aromatics. The results of tests of the electrical properties of blends of this fraction with the aromatic oil produced by the hydrogenation, catalytic reforming, and fractionation of a naphtha boiling range feedstock as described above are shown in Table VI below:

Table VI

| | | Electrical Tests of Blended Oils and Components | | | | |
|---|---|---|---|---|---|---|
| | | AC Breakdown Voltage | | DC Breakdown Voltage* | | Gassing |
| Sample | Material | ASTM D-877, KV | ASTM D-1816, KV | Negative, KV | Positive, KV | μl/min. |
| (1) | Isoparaffinic Fraction** | 38.7 | 44.7 | 59.0 | 35.6 | +9.0 |
| (2) | Aromatic Oil*** | 52.9 | 50.3 | 104.9 | 96.7 | −116.5 |
| (3) | Blend of 50 Vol. % of (1) and 50 Vol. % of (2) | 46.6 | 61.4 | 85.1 | 93.4 | −168.0 |
| (4) | Blend of 75 Vol. % of (1) and 25 Vol. % of (2) | 41.4 | 60.7 | 82.9 | 40.5 | −111.2 |

*Point to sphere electrodes, 0.25-inch gap
**500° F. to 600° F. isoparaffinic fraction produced by hydrogenation of alkylate bottoms. This fraction contained about 50 wt. % isoparaffins, substantial quantities of naphthenes and olefins, and about 3 wt. % aromatics.
***414° F. to 600° F. aromatic oil produced by hydrogenation of petroleum naphtha, catalytic reforming of hydrogenated product, and fractionation of reformate to produce a distillate boiling above the end point of the feed naphtha but below 600° F.

Although only a limited number of tests were run on the blends of the isoparaffinic fraction and the aromatic oil, it will be apparent from the above table that the blends had relatively high direct current breakdown voltages and strongly negative gassing values, indicating good electrical stability and the ability to absorb large quantities of hydrogen gas. These results thus show that the aromatic oil can be blended with low aromatic electrical oil basestocks other than that employed in the tests of Table III above to produce electrical insulating oils having improved properties.

Figure 2:
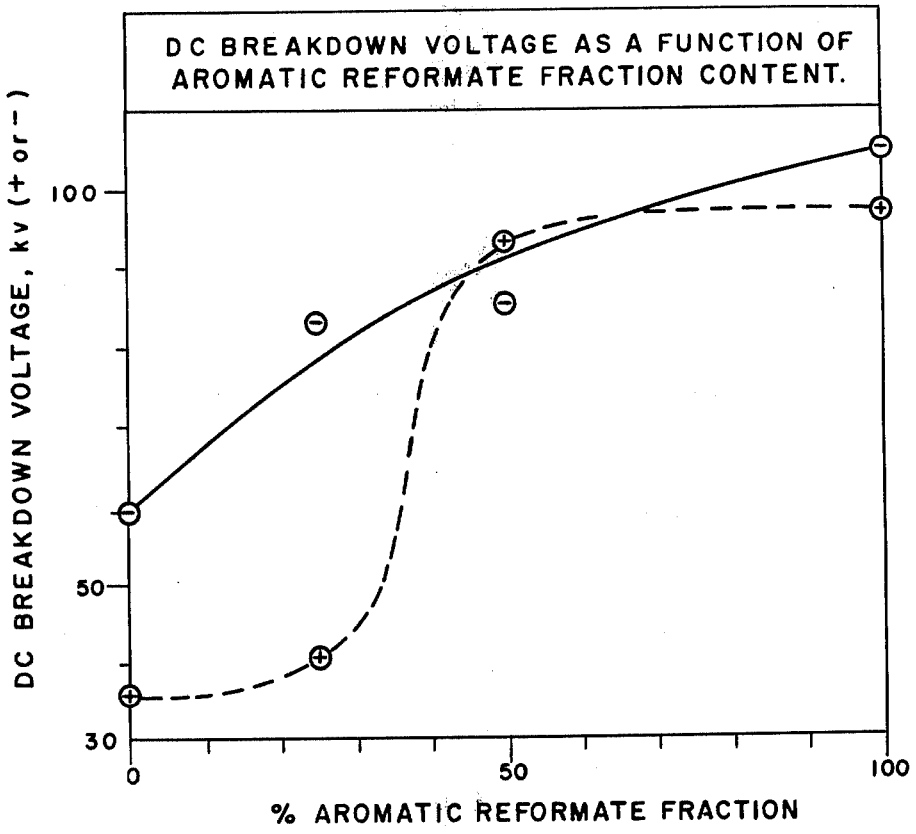
FIG. 2 is a graph illustrating electrical properties of oils prepared in accordance with the invention.

The aromatic oil and isoparaffinic fractions of the type referred to above are particularly useful when blended in proportions ranging up to about 75 volume percent of the isoparaffinic oil. This is illustrated in FIG. 2 of the drawing, which shows the positive and negative breakdown voltages obtained with blends of the aromatic oil with such an isoparaffinic fraction. It can be seen from FIG. 2 that the positive direct current breakdown voltage values are considerably lower than the negative values at low concentrations of the aromatic oil but that the positive value begins to increase rapidly at concentrations of the aromatic oil in excess of about 25 percent by volume. At aromatic oil concentrations above about 50 volume percent, the positive and negative values are both quite high and are significantly better than those of conventional oils.

It will be apparent from the foregoing that this invention provides improved electrical insulating oils which have surprisingly better electrical properties than the oils available heretofore. As pointed out earlier, these oils can be further improved by the addition of antioxidants, pour point depressants, and the like. A wide variety of additives useful in these and other insulating oils have been disclosed in the literature and will be familiar to those skilled in the art.

We claim:

1. An improved electrical insulating oil characterized by negative direct current impulse strength values in excess of about 200 kilovolts, positive direct current impulse strength values in excess of about 130 kilovolts, and negative gassing values of −20 μl/min. or lower; said insulating oil consisting essentially of a highly aromatic hydrocarbon oil which has been derived from a catalytic reformate and has a boiling range between about 400° F. and about 700° F., contains less than about 1.0 weight percent of polar compounds, and includes less than about 2.5 weight percent of polynuclear aromatic compounds having four or more condensed aromatic rings per molecule; and up to about 75 percent by volume of a low aromatics hydrocarbon oil which boils between about 350° F. and about 900° F. and has an aromatics content below about 20 percent by weight; said insulating oil having a viscosity at 100° F. between about 50 and about 300 Saybolt Universal Seconds, a pour point below about 15° F., and a flash point of at least about 265° F.

2. An insulating oil as defined by claim 1 wherein said highly aromatic hydrocarbon oil contains in excess of about 95 weight percent of aromatic compounds and boils between about 400° F. and about 625° F.

3. An insulating oil as defined by claim 1 wherein said low aromatics hydrocarbon oil is a hydrogen-treated petroleum distillate.

* * * * *